United States Patent [19]

Ataka et al.

[11] Patent Number: 4,460,118

[45] Date of Patent: Jul. 17, 1984

[54] METHOD FOR FORMING ELECTRIC WELDED PIPE

[75] Inventors: Matsuo Ataka; Itaru Aoki; Takashi Horita; Takehisa Nagao, all of Tokai, Japan

[73] Assignee: Nippon Steel Corporation, Tokyo, Japan

[21] Appl. No.: 383,197

[22] Filed: May 28, 1982

[30] Foreign Application Priority Data

May 29, 1981 [JP] Japan ..... 56-81100

[51] Int. Cl.[3] ..... B23K 31/06; B21D 5/12; B21D 39/03

[52] U.S. Cl. ..... 228/146; 72/51; 72/181; 228/151

[58] Field of Search ..... 72/51, 52, 177, 179, 72/181, 368; 228/17, 17.5, 146, 147, 151

[56] References Cited

U.S. PATENT DOCUMENTS

| | | | |
|---|---|---|---|
| 330,338 | 11/1885 | Lippincott | 228/151 |
| 1,816,534 | 7/1931 | Hume | 228/151 |
| 2,025,922 | 12/1935 | Weinrich | 228/151 X |
| 4,148,426 | 4/1979 | Midzutani et al. | 72/51 X |
| 4,294,095 | 10/1981 | Kawano et al. | 72/51 |
| 4,373,365 | 2/1983 | Taira et al. | 72/52 |

FOREIGN PATENT DOCUMENTS

| | | | |
|---|---|---|---|
| 831534 | 2/1952 | Fed. Rep. of Germany | 72/52 |
| 743508 | 4/1933 | France | 72/52 |

*Primary Examiner*—E. Michael Combs

*Attorney, Agent, or Firm*—Wenderoth, Lind & Ponack

[57] ABSTRACT

In a method for roll forming a flat metal strip through a roll forming machine into a round tubular product while the metal strip is being lengthwise fed therethrough, an improved method wherein regions of a specified width extending inward from the edges of said strip are imparted with substantially zero curvature. The tube forming method prevents decrease in the wall thicknesses at the edges when used in the manufacture of a thick walled electric welded pipe, and prevents the occurrence of edge buckling and springback when used in the manufacture of thick walled pipe so that in either case a proper and satisfactory butt junction for subsequent welding can be obtained.

4 Claims, 28 Drawing Figures

METHOD FOR FORMING ELECTRIC WELDED PIPE

BACKGROUND OF THE INVENTION

Field of the Invention

The present invention relates to a method for forming a flat strip of metal into a tubular form, and more particularly, to an electric resistance welded tubular product the weld seam line of which extends parallel with the longitudinal axis of the tubular product.

In general, the roll forming process for progressively forming a flat metal section into a round form prior to electric resistance welding makes use of various types of rolls, such as, breakdown rolls, fin pass rolls and squeeze rolls, in accordance with the respective forming steps.

In the conventional tube forming method, the regions near the metal strip edges have been subjected to bend forming at the initial stage of the breakdown roll forming, and the curvature of the bending is gradually increased in such manner that the cross section of the metal strip in the direction perpendicular to the tubular axis is shaped to approach to a round form.

In the manufacture of a tubular product having a thick wall thickness (hereinafter referred to "thick walled tube or pipe"), however, the above known forming method has a defect as follows: when the strip edges are forcibly bent by the breakdown roll, the wall thickness of the strip is greatly decreased so that a proper butt junction, for instance an I groove, cannot be obtained, even though the wall thickness of the pipe is increased by drawing the formed pipe through the subsequent fin pass forming step. Moreover, in the manufacture of a tubular product having a thin wall thickness (hereinafter referred to "thin walled tube or pipe") by means of the above-mentioned conventional method, the regions near the sheet edge are elongated in the lengthwise direction so that "edge buckling" is likely to occur.

Furthermore, "springback" is apt to occur when the cross section of the pipe approaches roundness by gradually increasing the curvature, so that the edges will not meet to form an I groove but tend to form a V groove, which results in a defective butt weld. In addition, if edge buckling should remain in the welded joint, the butt weld will be offset and defective.

SUMMARY OF THE INVENTION

The present invention has been made to overcome the above problems encountered in the forming of a metal pipe, and it is a principal object of the invention to provide a method for forming an elongated flat strip of metal into an excellent tubular form, particularly, a tubular form free from misalignment of the edges to be welded.

In accordance with the present invention the above object is attained by maintaining portions of specified width at both edges of a metal sheet unbent and with substantially zero curvature from the initial forming up to the time of welding as the metal sheet is transferred in its lengthwise direction while being formed into a pipe by a roller forming machine.

BRIEF DESCRIPTION OF THE DRAWINGS

Other and further objects of the invention will be better understood from the following detailed description with reference to the accompanying drawings, in which.

DETAILED DESCRIPTION OF THE INVENTION

To facilitate an understanding of this invention, a detailed description of the conventional metal tube forming method, particularly the conventional method of forming electric resistance welded pipe (hereinafter referred to as "electric welded pipe") will be given hereinbelow.

In general, the roll forming process for production of electric welded pipe is divided roughly into breakdown roll forming, fin pass roll forming and squeeze roll forming, in accordance with the respective forming steps. In the conventional pipe forming process, a bend forming step has been carried out on regions near the strip edges (hereinafter referred to as "strip edges") at the initial stage of the breakdown roll forming step, and subsequently bend forming steps have been continued with a gradual increase of curvature.

As mentioned above, in the manufacture of a thick walled pipe, however, the above forming process has a disadvantage which will be explained in more detail below.

Figure 1:
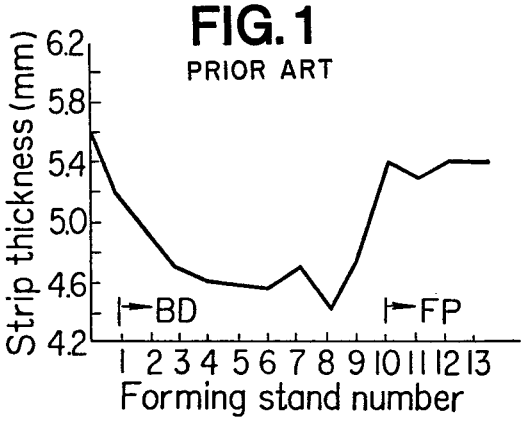
FIG. 1 PRIOR ART
FIG. 1 is a graph showing how the wall thickness of the strip edges is reduced during the respective passes of the forming step.

FIG. 1 is a graph showing how the wall thickness of a strip edge is reduced by the passes of the conventional forming process in the forming of a thick walled pipe. It is seen that the decrease in the wall thickness starts at the initial stage of breakdown roll forming and continues until just before the wall thickness is increased by the drawing operation of the fin pass roll forming step. In FIG. 1, BD stands for breakdown roll forming while FP stands for fin pass roll forming.

Figure 2A:
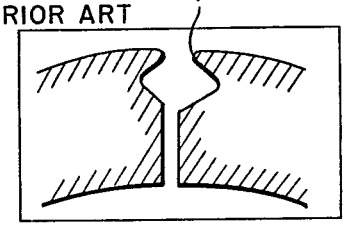
FIG.2a PRIOR ART
FIGS. 2*a, b* and *c* are explanatory views showing two edges to be butted.
Figure 2B:
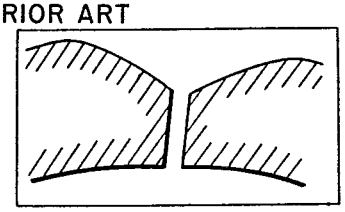
FIG.2b PRIOR ART
Figure 2C:
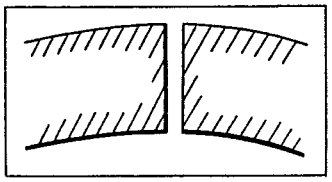

FIGS. 2(*a*) and 2(*b*) show the butt junctions obtained in the above process. Namely, where the drawing in the fin pass rolls is large, a tongue-like projection P appears on the outside of the edges as shown in FIG. 2*a* despite the increase of the wall thickness, while, on the other hand, where the drawing is small an extreme Y-shaped groove appears as shown in FIG. 2*b*. Thus an ideal I-shaped groove as indicated in FIG. 2*c* cannot be obtained by the above forming steps.

Figure 3A:
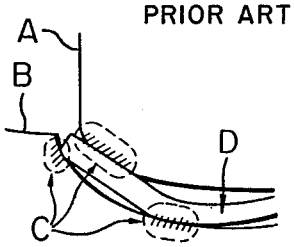
FIG.3a PRIOR ART
FIGS. 3*a* and *b* are explanatory views showing breakdown roll forming and the resultant equivalent models.

The forming limit of the strip edge is considered in FIG. 3*a* and *b*. FIG. 3*a* is a view explaining the forming process by the breakdown rolls in which the hatched portions C of the strip D are strongly engaged by an upper roll A and a lower roll B. Accordingly, the strip D is bent along the lower roll B by the upper roll A. This phenomenon is represented in the form of a model in FIG. 3*b* in which the region l where the edge portion is bent with no change of strip thickness t at all is obtained as follows:

$$l > \sqrt{2}t$$

Figure 3B:
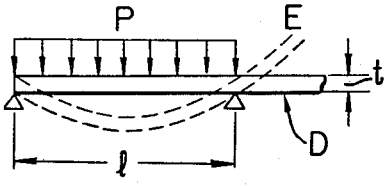
FIG.3b PRIOR ART

Therefore it is very difficult to bend the strip with no decrease in the thickness t of the more inward portions thereof. In FIG. 3*b*, P refers to the load and E to the imaginary curvature of the strip.

Figure 4A:
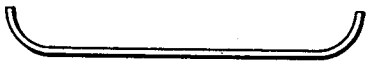
FIG.4a PRIOR ART
FIGS. 4*a, b* and *c* are graphs illustrating strain in the transverse direction and residual stress in the transverse direction of the strip.
Figure 4B:
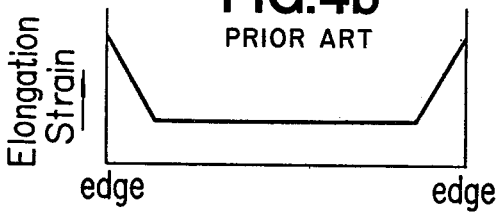
FIG.4b PRIOR ART
Figure 4C:
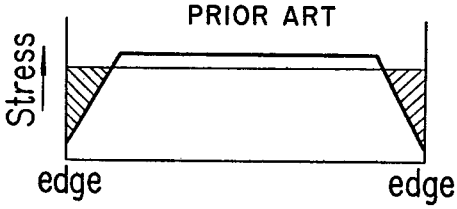
FIG.4c PRIOR ART

In addition, in the manufacture of a thin walled pipe, the above forming method also has the following defect. Namely, in general, in the roll forming process, the strip edges are elongated in the lengthwise direction, and the resulting elongation strain is a cause of edge buckling. This tendency is particularly conspicuous in an edge bend as shown in FIG. 4*a*. When the edge bending shown in FIG. 4*a* is carried out, the strip edges are elongated in the lengthwise direction as indicated in FIG. 4*b* which shows the elongation strain of the strip edges in the lengthwise direction. Accordingly, when in the state of equilibrium, the strip has distribution of stress as shown in FIG. 4*c*. In other words, a compression stress occurs in the strip edges as depicted in the hatched portion of FIG. 4*c*, while a tensile stress is present in the center of the strip. Thus buckling tends to occur at the edges.

Figure 5:
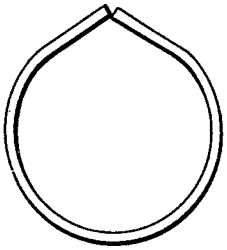
FIG.5 PRIOR ART
FIG. 5 is an end view of a defective edge butt junction resulting from springback.

The known tube forming process adopts a process wherein the cross section of the strip is made to approach a round form with a gradually increasing curvature. However, in this case, on account of springback, the shape of the butt junction at the weld does not form an I-shaped groove as illustrated in FIG. 5, but form a V-shaped groove, which readily gives rise to a defective weld.

Figure 6:
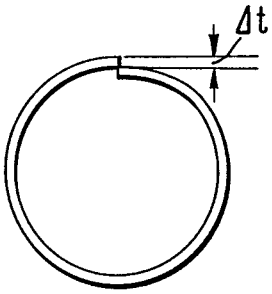
FIG.6 PRIOR ART
FIG. 6 is an end view showing an example of a defective edge butt junction resulting from edge buckling.

In addition, if edge buckling should remain in the weld, the weld butt becomes offset by $\Delta t$ as indicated in FIG. 6, which also results in a defective weld.

The present invention overcomes the above defects of the conventional tube forming process, and is directed to the provision of an ideal butt junction at the strip edges by preventing the decrease of the wall thickness due to bending work at the edges during the manufacture of a thick walled pipe, and by additionally preventing the occurrence of edge buckling due to the edge bending operation in the manufacture of a thin walled pipe, and further, by preventing the deterioration of the butt junction due to springback.

Thus, it is a prime object of the invention to provide a novel method for roll forming a tubular product for use in a thick walled electric welded pipe in a most reasonable manner, whereby electric butt welding of the thus formed pipe can easily be carried out.

The present invention is characterized in that, in the roll forming of a thick walled pipe, the roll forming process comprises roll forming a flat strip of metal into an elliptic form without bending regions extending inwardly from both edges a specified distance l according to the expression ($0.5t < l < 2.0t$). In the present invention, a thick walled electric welded pipe is generally defined as one wherein $t/D \geqq 0.10$, wherein t is the thickness of the strip and D is the outside diameter of the pipe, and which is produced by roll forming.

Figures 7A, 7B:
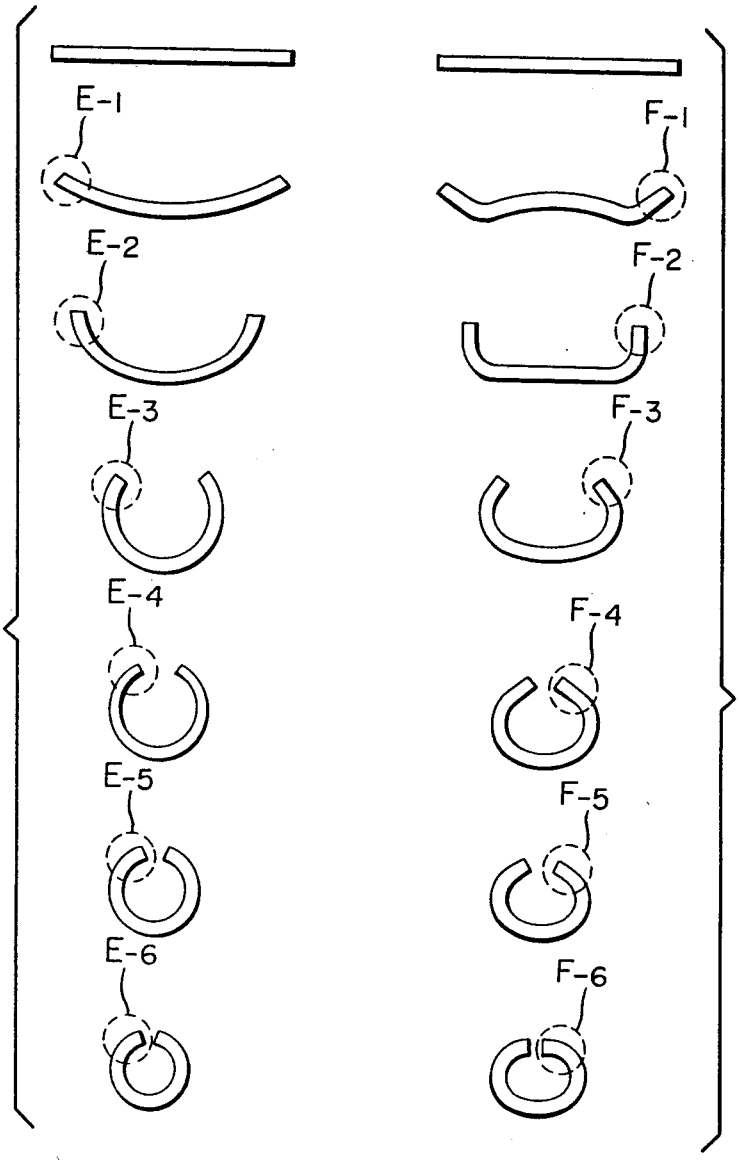
FIG.7a PRIOR ART
FIGS. 7*a* and 7*b* are two series of explanatory views showing a series of conventional forming steps and a series of forming steps in accordance with the present invention, respectively.

FIGS. 7*a* and 7*b* illustrate two different roll forming processes. The process of FIG. 7*a* is that conventionally used while the process of FIG. 7*b* is that of the present invention. It is seen that gradually increasing curvature is given to the edges E-1 to E-6 in the series of steps shown in FIG. 7*a*, while in FIG. 7*b* the edges F-1 to F-6 are not subjected to bending, but the curvature thereof remains zero up to the last forming step.

Figures 8A, 8B:
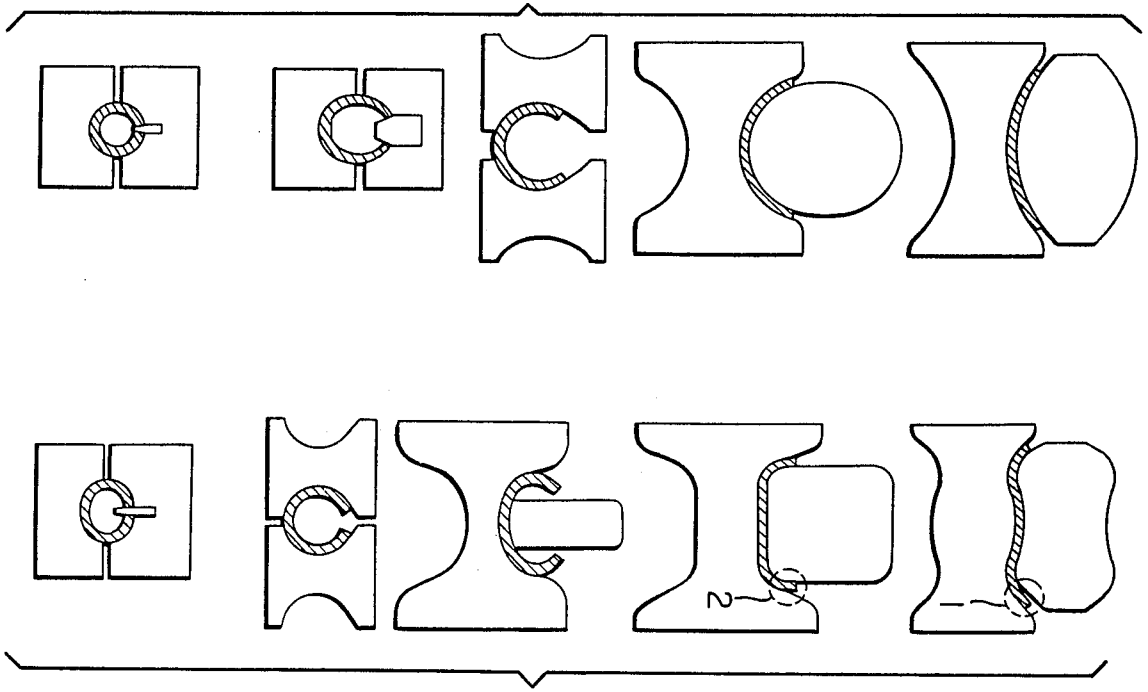
FIG.8a PRIOR ART
FIGS. 8*a* and 8*b* are two series of explanatory views showing the changes in curvature during roll forming of a plate in accordance with the conventional method and the present invention, respectively.

As shown in FIG. 8*b*, in the present invention, the edges are protected from damage by not being brought in contact with the forming roll at the initial stage of breakdown roll forming. FIG. 8*a* shows a series of forming steps in accordance with the conventional method. In FIG. 8*b*, the reference numeral 1 shows a case where the upper roll is kept out of contact with the edges while the numeral 2 shows a case where the lower roll is kept out of contact with the edges.

Figure 9A:
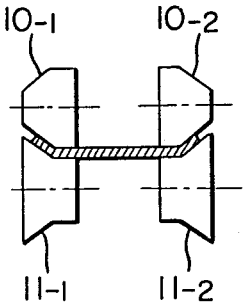
FIGS. 9*a* and 9*b* are explanatory views showing how the edges of a plate are bent in accordance with the invention.
Figure 9B:
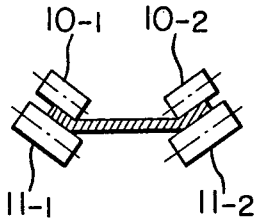

In further breakdown roll forming of the edges, so as to keep the edges with a curvature of zero in accordance with this invention, there can be used a pair of truncated conical rolls 10, 11 as shown in FIG. 9*a*, a pair of oblique rolls 10, 11 as shown in FIG. 9*b* or any of various other arrangements.

Figure 10:
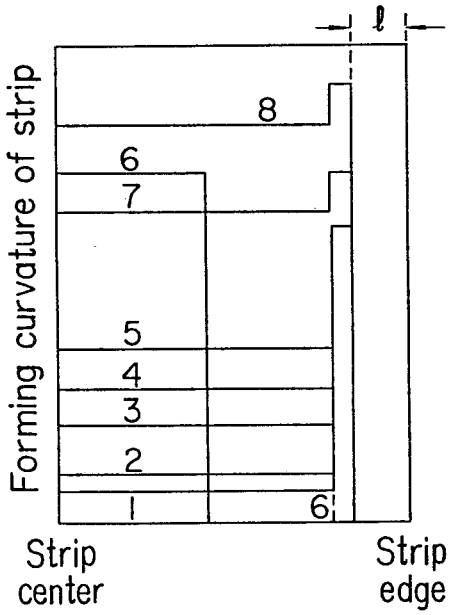
FIG. 10 is a graph showing the changes in curvature during roll forming of a plate in accordance with this invention.

With a view to describing the present invention in more detail, an example of the transition in strip curvature during roll forming in accordance with this invention is shown in FIG. 10. It is seen that a prime feature of the invention consists in maintaining specified regions extending a distance l inward from the edges of the strip at zero curvature from the begining to the end of the roll forming process. However, it should be noted that, in the fin pass roll forming step, although the strip is not subjected to positive roll forming at a smaller drawing ratio than that used in the conventional method, the fin pass roll forming step may, in view of the nature thereof, impart a small amount of curvature to the edge regions. In FIG. 10 the numerals denote pass numbers.

As fully described in the foregoing, the decrease in thickness of the strip edges and the formation of a tongue-like projection at the edges are so completely eliminated by the roll forming method of the invention that an ideal butt junction can be obtained.

The method of the present invention, which uses a roll forming machine, differs from the UO (U-ing and O-ing) forming process using a large scale press machine in the following respects:

(a) Since the roll forming process used in the present invention is a continuous one, the roll forming imparted by a given stand is restricted by the forming ratios of the stands ahead and behind, the distance from these adjacent stands, and the levels of the roll forming pass lines of the adjacent stands.

(b) In the roll forming process, the forming can be controlled by varying the rotational velocity of the rolls so as to vary the force between stands.

(c) The ratio of t/D in UO forming is much smaller than that of this invention.

The present invention has a conspicuous advantage in the formation of thick walled pipes in which the decrease in wall thickness is great at the time of pipe forming. In the production of a pipe wherein $t/D \geqq 0.10$, the specified distance l from the edges of the strip is preferably selected within the range of 0.5t–2.0t in accordance with the quality, particularly the hardness, of the raw stock. If l exceeds 2.0t, it is very difficult to finally form the steel strip into a round pipe.

Next, the roll forming of a thin walled electric welded pipe will be described.

In this invention, a thin walled electric welded pipe is generally defined as one wherein $t/D < 0.10$, and which is produced by the roll forming process.

In the roll forming of thin walled electric welded pipes ($t/D < 0.10$), this invention is again characterized by the fact that the roll forming is carried out while maintaining the curvature of regions extending a specified distance l inward from the edges of the strip at substantially zero. In the case of thin walled pipes, l is selected so as to be within the range of $2t < l < 10t$.

FIG. 11 shows a series of successive forming steps for the formation of a thin walled electric welded pipe.

As clearly shown in FIG. 11, strip edge regions of specified width are not subjected to bending; in other words, they are maintained at zero curvature throughout the forming process. The principal feature of the invention lies in the presence of these regions of zero curvature from the start to the finish of the roll forming process.

However, it should be noted that, in the fin pass roll forming step, although the strip is not subjected to positive bending at a smaller drawing ratio than that used in the conventional method, the fin pass roll forming step may, in view of the nature thereof, impart some degree of curvature to the edge regions.

In FIG. 11 are shown two possible series of forming steps, (a) and (b), that can be carried out prior to fin pass roll forming. As regards the series (b), the bending process is similar to that in UO forming. However, as the UO forming process is substantially two-dimensional, it is essentially different from the roll forming process wherein forming at each stand is restricted by the adjacent stands.

As illustrated in FIG. 11, the strip edge is prevented from touching the roll in order to prevent damage at the initial stage of breakdown roll forming. In FIG. 11 the numeral 1 indicates where the upper roll is not in contact with the strip edges and the numeral 2 shows where the lower roll is not in contact with the edges. Numerals 3-1 and 4-1 indicate where the curvature is zero.

The process for further bending the edges while maintaining them at zero curvature is carried out in the same manner as shown in FIG. 9.

Figure 12:
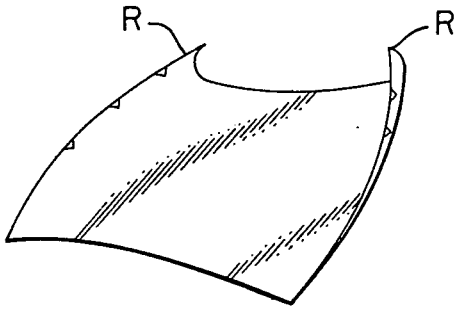
FIG. 12 is a perspective view illustrating edge buckling.
Figure 13A:
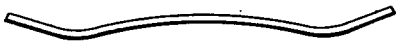
FIGS. 13*a*–13*c* are graphic views showing elongation strain in the lengthwise direction and the distribution of residual stress in another forming process according to the invention.
Figure 13B:
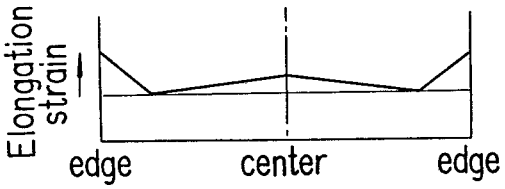
Figure 13C:
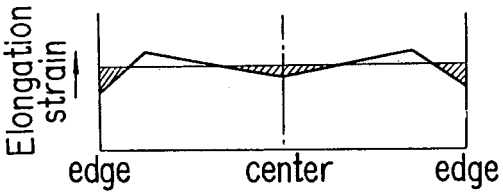

Generally speaking, in the roll forming process, edge buckling R as shown in FIG. 12 tends to occur owing to the edge bending being carried out at the initial stage of breakdown roll forming. As clearly shown in FIGS. 13*a*–13*c*, however, in accordance with the present invention, the occurrence of edge buckling can be prevented by elongating not only the edge portions but also the center portion so that the compressive stress (shown by the hatched portion in FIG. 13) is partially distributed to the center portion with the result that the compressive stress at the edges is reduced.

Figures 11A, 11B:
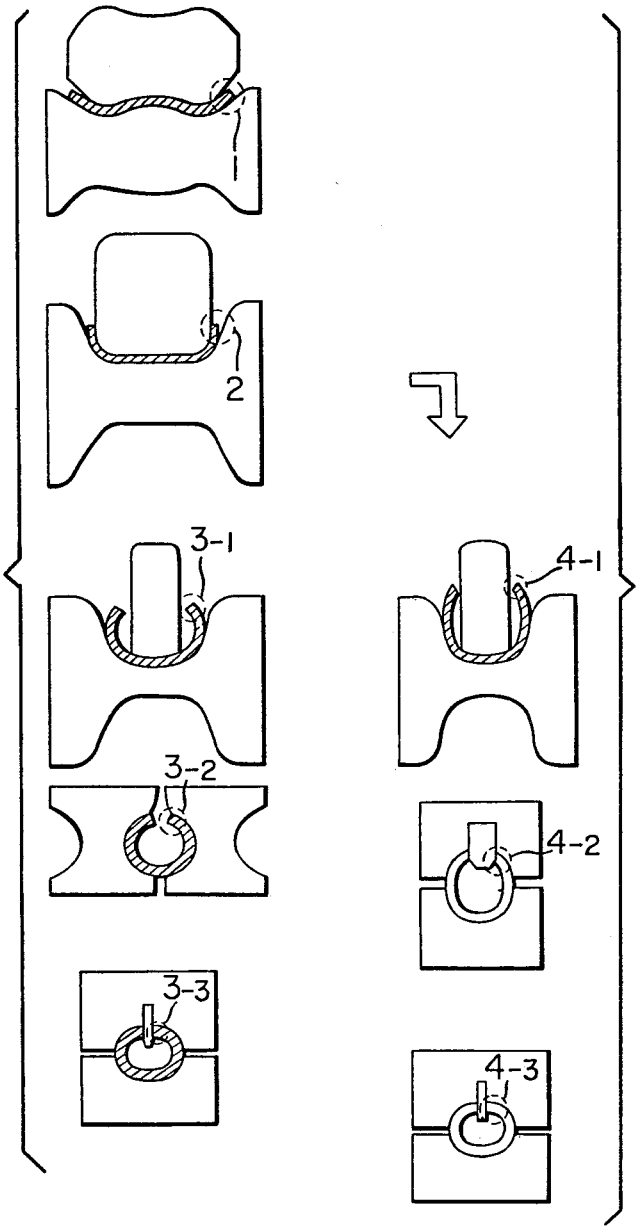
FIG. 11*a* is a series of explanatory views showing the steps in forming of a thin walled pipe in accordance with the invention and FIG. 11*b* is a series of explanatory views of variations of certain steps of FIG. 11*a;*

As indicated in FIG. 11*b*, the metal material is formed into a U-like cross section so that the shoulder portions need only bend along the caliber of the fin pass roll. Although the strip is bent as shown in FIG. 10, the elongation of the edge regions can be presumed to be slight.

Next, the reason why this invention provides a better butt junction than the conventional method will be explained hereinbelow.

Figure 14A:
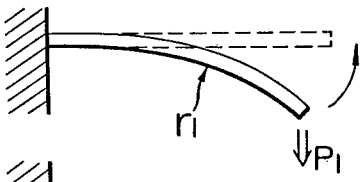
FIGS. 14*a* and 14*b* are explanatory views illustrating the relation between bending radius and springback.
Figure 14B:
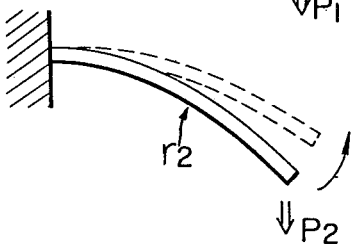

FIGS. 16*a*–14*b* illustrate the relation between bending radius and springback using a theoretical model. In FIG. 14*a*, it is seen that if the bending radius is great, plastic deformation proceeds only slightly, so that the material resumes its initial state after the load is removed.

However, as shown in FIG. 14*b*, when the bending radius is small, the plastic deformation extends in the direction of strip thickness so that the strip material recovers only slightly when the load is removed. In FIGS. 14*a* and 14*b*, the relation between $\gamma_1 > \gamma_2$ is established. Therefore, where the bending radius is small, the springback is also small. Hence it is seen that the springback is also small in this invention. Accordingly, an ideal I-shaped groove can easily be prepared by the method of the invention.

The present invention is particularly effective when used in the production of thin walled pipe wherein edge buckling or roofing and the like tend to occur. For optimum effect in producing thin walled pipe, however, the specified width l of the edge regions should be selected according to the value of t/D. For instance, where $t/D = 0.10$, it is preferable for l to equal about 2t; and where $t/D = 0.01$, it is preferable for l to equal about 10t. If l is larger than 10t, it is difficult to finally make the finished pipe round in the sizing roll forming step following the welding operation.

Next, the present invention will be described in connection with examples.

EXAMPLE 1

Figure 15:
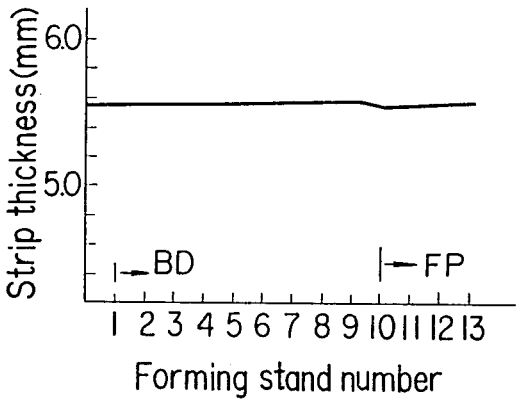
FIG. 15 is a graph indicating the change in the wall thickness of the strip in accordance with an embodiment of the invention.

FIG. 15 shows the change in the strip thickness when the method according to this invention was carried out under the condition of $t/D = 0.18$ and $l = 1.0t$. In the fin pass roll forming step, almost no drawing was performed; this forming step amounted substantially to pushing down the top to form an ellipse, so that there was almost no change in strip thickness. The butt junction obtained was as near an ideal I-shaped groove as could possibly be expected. In FIG. 15, BD stands for breakdown roll forming and FP for fin pass roll forming.

EXAMPLE 2

Figure 16:
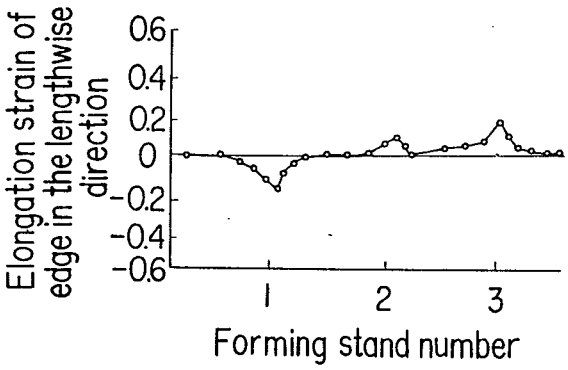
FIG. 16 is a graph showing the change in elongation strain of the strip edges in accordance with another embodiment of the invention.

FIG. 16 shows the elongation strain in the edge regions when the invention was carried out under the conditions of $t/D=0.02$ and $l=7.0t$. In the No. 1 forming stand of the breakdown forming step, the edge regions were not elongated, but tended to be compressed. Hence there was no worry about edge buckling. Thus, an I-shaped groove approaching ideal form could be obtained.

We claim:

1. In a method for making an electric resistance welded tubular product, which comprises transporting a flat strip in the direction of its length while subjecting the flat strip to the successive steps of breakdown roll forming, fin pass roll forming, and squeeze roll forming to form a butt junction between the opposite edges of the strip which has an I-shaped groove, and finally butt resistance welding said butt junction at the I-shaped groove, the improvement comprising:

carrying out the initial stage of the breakdown roll forming while keeping a region l measured inwardly in the width direction from each edge of said flat strip out of contact with at least one of the pair of opposed breakdown rolls used for the initial stage of breakdown roll forming so that said regions l have substantially zero curvature in the width direction of the strip; and carrying out further breakdown rolling of said regions l by at least one pair of breakdown rolls which have roll profiles for maintaining the zero curvature of said regions.

2. The improvement as claimed in claim 1 further comprising subjecting the regions l to bending along the caliber of the fin pass rolls during said fin pass roll forming.

3. The improvement as claimed in claim 1 in which the ratio of the thickness t of the strip to the outside diameter D of the finished pipe is in the relationship $t/D \geqq 0.10$, and the width of said regions l is according to the relationship $0.5t<l<2.0t$.

4. The improvement as claimed in claim 1 in which the ratio of the thickness t of the strip to the outside diameter D of the finished pipe is in the relationship $t/D<0.10$, and the width of said regions l is according to the relationship $2t<l<10t$.

* * * * *